US010815769B2

(12) United States Patent
Harrigan

(10) Patent No.: US 10,815,769 B2
(45) Date of Patent: Oct. 27, 2020

(54) DOWNHOLE TENSION SENSING APPARATUS

(71) Applicant: Impact Selector International, LLC, Houma, LA (US)

(72) Inventor: Edward Harrigan, Richmond, TX (US)

(73) Assignee: Impact Selector International, LLC, Houma, LA (US)

( * ) Notice: Subject to any disclaimer, the term of this patent is extended or adjusted under 35 U.S.C. 154(b) by 184 days.

(21) Appl. No.: 16/072,832

(22) PCT Filed: Jan. 25, 2017

(86) PCT No.: PCT/US2017/014964
§ 371 (c)(1),
(2) Date: Jul. 25, 2018

(87) PCT Pub. No.: WO2017/132272
PCT Pub. Date: Aug. 3, 2017

(65) Prior Publication Data

US 2019/0032470 A1 Jan. 31, 2019

Related U.S. Application Data

(60) Provisional application No. 62/286,829, filed on Jan. 25, 2016.

(51) Int. Cl.
*E21B 47/007* (2012.01)
*E21B 17/02* (2006.01)
(Continued)

(52) U.S. Cl.
CPC ..... *E21B 47/007* (2020.05); *E21B 17/028* (2013.01); *E21B 43/11* (2013.01); *E21B 47/12* (2013.01)

(58) Field of Classification Search
CPC .... E21B 47/0006; E21B 17/028; E21B 43/11; E21B 47/12; E21B 47/00; E21B 17/02
See application file for complete search history.

(56) References Cited

U.S. PATENT DOCUMENTS 3,855,857 A 12/1974 Claycomb
4,805,449 A * 2/1989 Das ..... G01L 9/0089 73/152.48

(Continued)

FOREIGN PATENT DOCUMENTS

WO 2017132287 A1 8/2017

OTHER PUBLICATIONS

PCT/US2017/014968 International Search Report and Written Opinion dated May 23, 2017, 12 pages.

*Primary Examiner* — Yong-Suk (Philip) Ro
(74) *Attorney, Agent, or Firm* — Boisbrun Hofman, PLLC

(57) ABSTRACT

Apparatus and method of sensing tension downhole, such as a measurement tool for coupling between opposing first and second portions of a tool string conveyable within a wellbore. The measurement tool may include a tension-bearing member, a load cell connected along the tension-bearing member and operable to generate information indicative of tension applied to the measurement tool, and electronic equipment communicatively connected with the load cell. The electronic equipment may be operable to record the information generated by the load cell and/or transmit the information generated by the load cell to a wellsite surface from which the wellbore extends.

25 Claims, 6 Drawing Sheets

(51) Int. Cl.
*E21B 43/11* (2006.01)
*E21B 47/12* (2012.01)

(56) References Cited

U.S. PATENT DOCUMENTS

| | | | | |
|---|---|---|---|---|
| 5,732,776 | A * | 3/1998 | Tubel | E21B 34/066 166/250.15 |
| 6,536,519 | B1 * | 3/2003 | Vaynshteyn | E21B 47/0905 166/250.13 |
| 2002/0148611 | A1 | 10/2002 | Williger et al. | |
| 2007/0165487 | A1 * | 7/2007 | Nutt | E21B 31/18 367/25 |
| 2008/0216554 | A1 | 9/2008 | McKee | |
| 2009/0071645 | A1 | 3/2009 | Kenison et al. | |
| 2013/0043074 | A1 * | 2/2013 | Tassaroli | E21B 43/1185 175/2 |
| 2015/0027736 | A1 | 1/2015 | Smaardyk et al. | |
| 2015/0059463 | A1 | 3/2015 | Kenison et al. | |
| 2015/0083408 | A1 | 3/2015 | Coles | |
| 2015/0167414 | A1 | 6/2015 | Coles et al. | |

* cited by examiner

DOWNHOLE TENSION SENSING APPARATUS

CROSS-REFERENCE TO RELATED APPLICATIONS

This application is a national stage of, and claims priority to and the benefit of, International Patent Application No. PCT/US2017/014964, titled "DOWNHOLE TENSION SENSING APPARATUS," filed Jan. 25, 2017, which claims priority to and the benefit of U.S. Provisional Application No. 62/286,829, titled "DOWNHOLE TENSION SENSING APPARATUS," filed Jan. 25, 2016, the entire disclosures of which are hereby incorporated herein by reference.

BACKGROUND OF THE DISCLOSURE

Drilling operations have become increasingly expensive as the need to drill deeper, in harsher environments, and through more difficult materials has become a reality. Consequently, in working with deeper and more complex wellbores, it becomes more likely that tools, tool strings, and/or other downhole equipment may experience problems during conveyance within such wellbores.

A downhole tool, often referred to as a perforating tool, may be utilized to perforate a casing, cement, and a subterranean formation surrounding the wellbore to prepare the well for production. The perforating tool may be included as part of the tool string and deployed downhole along with other downhole equipment. Tension may be applied by a tensioning device from a wellsite surface to the tool string via a conveyance means to convey the tool string within the wellbore. During or prior to performing the perforation operations, the tension applied to tool string may be monitored. However, in some downhole applications, such as in deviated wellbores or when multiple bends are present along the wellbore, friction between the conveyance means and a sidewall of the wellbore or the casing may prevent accurate determination of the tension applied to the tool string when measuring the tension at the wellsite surface.

Furthermore, electronic devices, such as correlation tools and downhole sensors are often configured to operate on a voltage having an opposite polarity from the voltage operating the perforating tool. Such configuration enhances safety as the tool string is not provided with a voltage that may detonate or trigger the perforating tool while the tool string is being conveyed. Such configuration also ensures that the correlation tools are not powered and, thus, able to transmit a signal to surface equipment when such surface equipment is communicating with the perforating tool. A downside to such configuration is that the correlation tools are not able to record data during perforation operations. Hence, it may be difficult to verify if the perforating tool has been successfully detonated.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
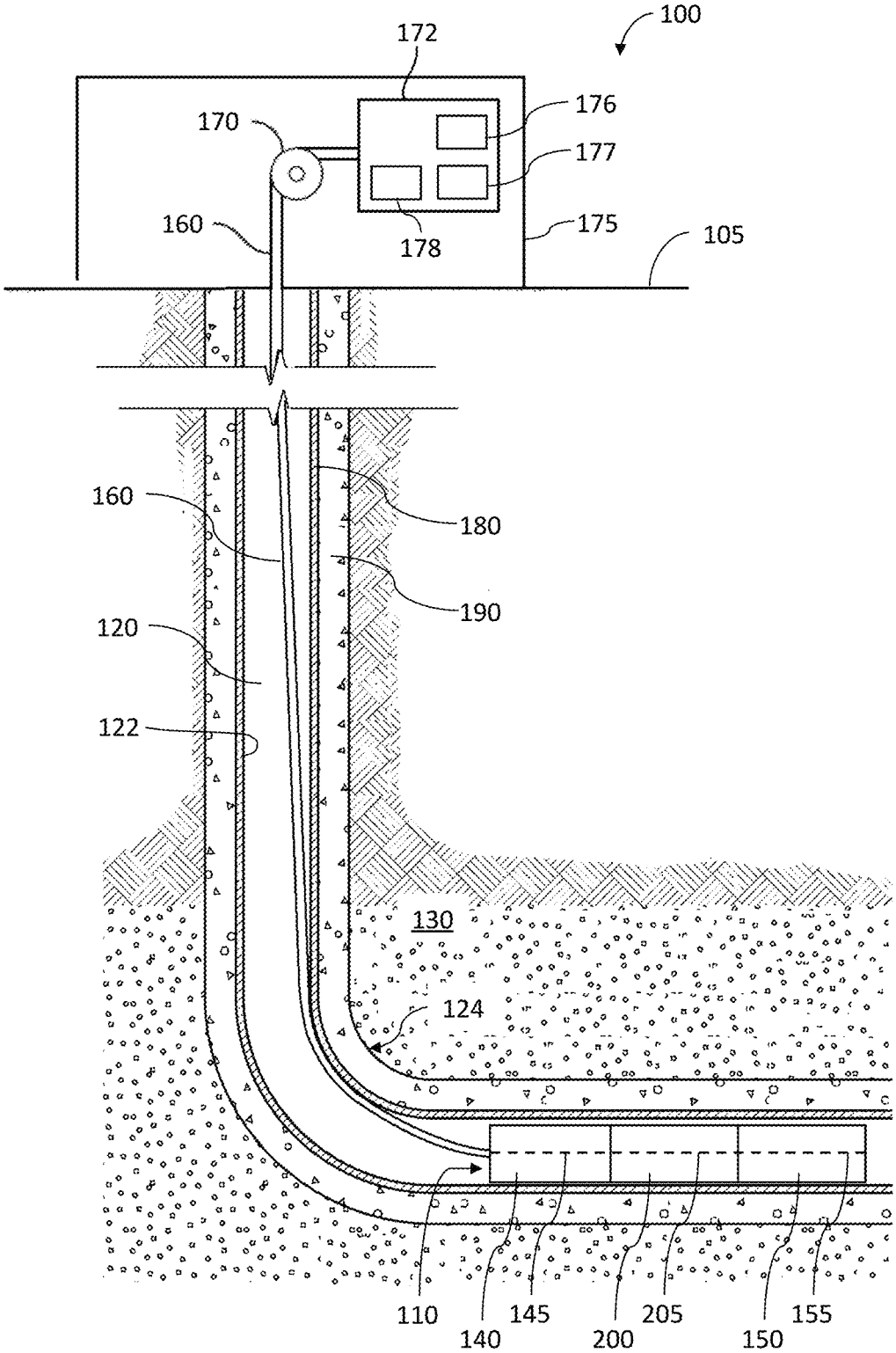
FIG. 1 is a schematic view of a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

FIG. 1 is a schematic view of at least a portion of a wellsite system 100 according to one or more aspects of the present disclosure. The wellsite system 100 may comprise a tool string 110 suspended within a wellbore 120 that extends from a wellsite surface 105 into one or more subterranean formations 130. The wellbore 120 is depicted as being a cased-hole implementation comprising a casing 180 secured by cement 190. However, one or more aspects of the present disclosure are also applicable to and/or readily adaptable for utilizing in open-hole implementations lacking the casing 180 and cement 190. The tool string 110 may be suspended within the wellbore 120 via a conveyance means 160 operably coupled with a tensioning device 170 and/or other surface equipment 175 disposed at the wellsite surface 105, including a power and control system 172.

The tensioning device 170 may apply an adjustable tensile force to the tool string 110 via the conveyance means 160 to convey the tool string 110 along the wellbore 120. The tensioning device 170 may be, comprise, or form at least a portion of a crane, a winch, a draw-works, a top drive, and/or another lifting device coupled to the tool string 110 by the conveyance means 160. The conveyance means 160 may be or comprise a wireline, a slickline, an e-line, coiled tubing, drill pipe, production tubing, and/or other conveyance means, and may comprise and/or be operable in conjunction with means for communication between the tool string 110, the tensioning device 170, and/or one or more other portions of the surface equipment 175, including the power and control system 172. The conveyance means 160 may also comprise a multi-conductor wireline and/or other electrical conductor(s) extending between the tool string 110 and the surface equipment 175. The power and control system 172 may include a source of electrical power 176, a memory device 177, and a controller 178 for receiving and process electrical signals from the tool string 110 and/or commands from a surface operator.

The tool string 110 is shown suspended in a non-vertical portion of the wellbore 120 resulting in the conveyance means 160 coming into contact with the casing 180 or a sidewall 122 of the wellbore 120 along a bend or deviation 124 in the wellbore 120. The contact may cause friction between the conveyance means 160 and the sidewall 122, such as may impede or reduce the tension being applied to the tool string 110 by the tensioning device 170. Although not shown, the conveyance means 160 may also be dragged along a bottom portion of the sidewall 122 of the non-vertical portion of the wellbore 120, resulting in additional friction between the conveyance means 160 and the sidewall 122.

The tool string 110 may comprise an upper portion 140, a lower portion 150, and a downhole sub or tool 200, coupled between the upper portion 140 and the lower portion 150. The upper and lower portions 140, 150 of the tool string 110 may each be or comprise one or more downhole tools, modules, and/or other apparatus operable in wireline, while-drilling, coiled tubing, completion, production, and/or other implementations. The upper portion 140 of the tool string 110 may comprise at least one electrical conductor 145 in electrical communication with at least one component of the surface equipment 175. The lower portion 150 of the tool string 110 may also comprise at least one electrical conductor 155 in electrical communication with at least one component of the surface equipment 175, wherein the at least one electrical conductor 145 and the at least one electrical conductor 155 may be in electrical communication via at least one electrical conductor 205 of the downhole tool 200. Thus, the electrical conductors 145, 155, 205 may connect with and/or form a portion of the conveyance means 160, and may include various electrical connectors and/or interfaces along such path, including as described below.

Each of the electrical conductors 145, 155, 205 may comprise a plurality of individual conductors, such as may facilitate electrical communication between the upper portion 140 of the tool string 110, the downhole tool 200, and the lower portion 150 of the tool string 110 and at least one component of the surface equipment 175, such as the power and control system 172. For example, the conveyance means 160 and the electrical conductors 145, 155, 205 may transmit and/or receive electrical power, data, and/or control signals between the power and control system 172 and one or more of the upper portion 140, the downhole tool 200, and the lower portion 150. The electrical conductors 145, 155, 205 may further facilitate electrical communication between two or more of the upper portion 140, the downhole tool 200, and the lower portion 150. Each of the upper portion 140, the lower portion 150, the downhole tool 200, and/or portions thereof may comprise one or more electrical connectors, such as may electrically connect the electrical conductors 145, 155, 205 extending therebetween.

The upper and lower portions 140, 150 of the tool string 110 may each be or comprise at least a portion of one or more downhole tools, modules, and/or other apparatus operable in wireline, while-drilling, coiled tubing, completion, production, and/or other operations. For example, the upper and lower portions 140, 150 may each be or comprise at least a portion of a cable head, a telemetry tool, a correlation tool, a directional tool, an acoustic tool, a density tool, an electromagnetic (EM) tool, a formation evaluation tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a release tool, a mechanical interface tool, a jarring or impact tool, a perforating tool, a cutting tool, a plug setting tool, and a plug.

Although FIG. 1 depicts the tool string 110 comprising a single downhole tool 200 directly coupled between two portions 140, 150, it is to be understood that the tool string 110 may include two, three, four, or more downhole tools 200 coupled together, or the downhole tools 200 may be separated from each other along the tool string 110 by the portions 140, 150. Furthermore, the tool string 110 may comprise a different number of portions 140, 150, wherein each portion 140, 150 may be directly and/or indirectly coupled with the downhole tool 200. It is also to be understood that the downhole tool 200 may be coupled elsewhere along the tool string 110, whether in an uphole or downhole direction with respect to the upper and lower portions 140, 150 of the tool string 110.

Figure 2:
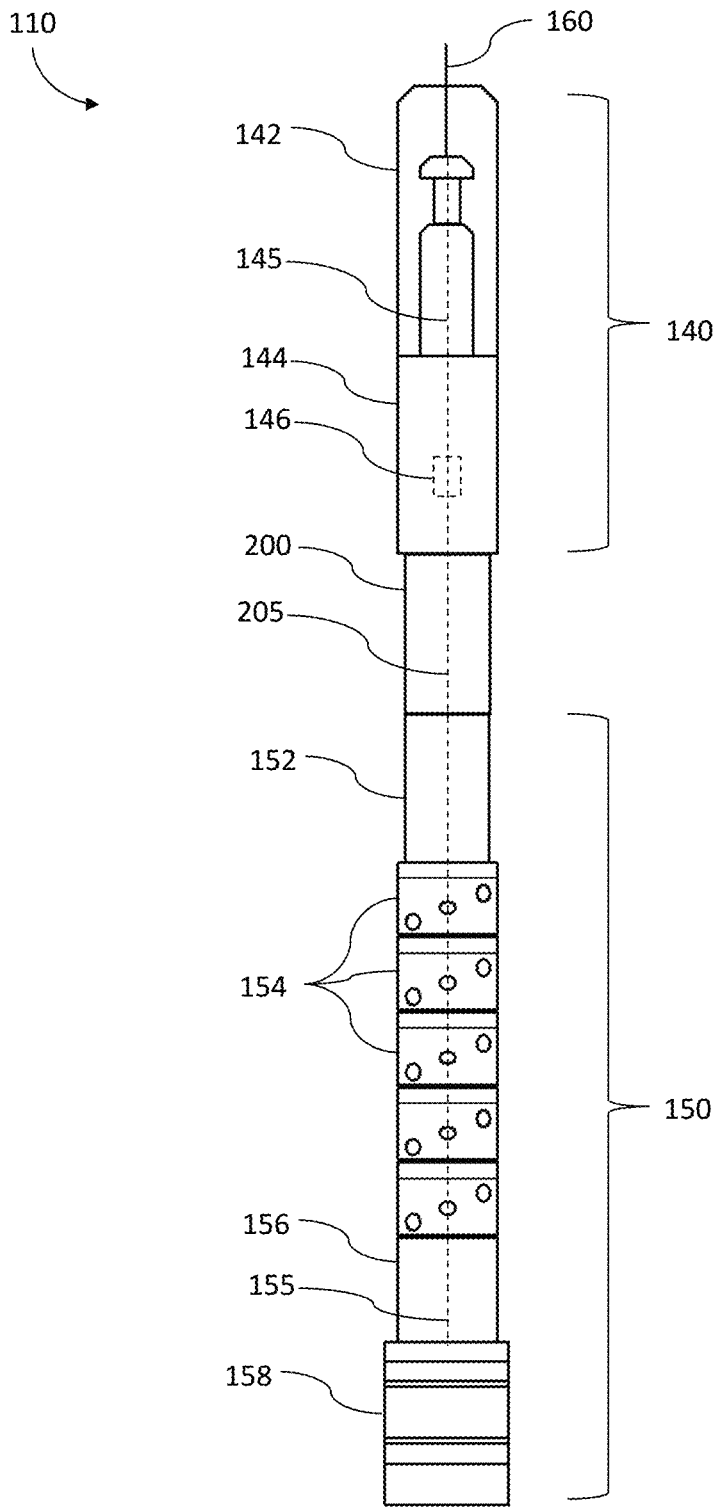
FIG. 2 is a side view of a portion of an example implementation of the apparatus shown in FIG. 1 according to one or more aspects of the present disclosure.

FIG. 2 is a side view of at least a portion of an example implementation of the tool string 110 shown in FIG. 1 according to one or more aspects of the present disclosure. The following description refers to FIGS. 1 and 2, collectively. The upper portion 140 of the tool string 110 may comprise a cable head 142, which may be operable to connect the conveyance means 160 with the tool string 110. The upper portion 140 may further comprise a control tool 144, which may comprise a controller 146, such as may be operable to store and/or receive control commands from the power and control system 172 via the electrical conductor 145 for controlling one or more portions and/or components of the tool string 110. For example, the control tool 144 may be further operable to store and/or communicate to the power and control system 172 signals or information generated by one or more sensors or instruments of the tool string 110. The control tool 144 may comprise inclination sensors and/or other position sensors, such as one or more accelerometers, magnetometers, gyroscopic sensors (e.g., micro-electro-mechanical system (MEMS) gyros), and/or other sensors for utilization in determining the orientation of the tool string 110 relative to the wellbore 120. The control tool 144 may further comprise a correlation tool, such as a casing collar locator (CCL) for detecting ends of casing collars by sensing a magnetic irregularity caused by the relatively high mass of an end of a collar of the casing 180. The correlation tool may also or instead be or comprise a gamma ray (GR) tool that may be utilized for depth correlation. The CCL and/or GR tools may transmit signals in real-time to the wellsite surface equipment 175, such as the power and control system 172, via the conveyance means 160. The CCL and/or GR signals may be utilized to determine the position of the tool string 110 or portions thereof, such as with respect to known casing collar numbers and/or positions within the wellbore 120. Therefore, the CCL and/or GR tools may be utilized to detect and/or log the location of the tool string 110 within the wellbore 120, such as during deployment within the wellbore 120 or other downhole operations.

The lower portion 150 of the tool string 110 may comprise one or more perforating guns or tools 154, such as may be operable to perforate or form holes though the casing 180, the cement 190, and the portion of the formation 130 surrounding the wellbore 120 to prepare the well for production. The perforating tools 154 may contain one or more shaped explosive charges operable to perforate the casing 180, the cement 190, and the formation 130 upon detonation. The lower portion 150 of the tool string 110 may also comprise a plug 158 and a plug setting tool 156 for setting the plug 158 at a predetermined position within the wellbore 120, such as to isolate a lower portion of the wellbore 120. The plug 158 may be permanent or retrievable, facilitating the lower portion of the wellbore 120 to be permanently sealed or temporarily isolated, such as during treatment operations conducted on an upper portion of the wellbore 120. The lower portion 150 of the tool string 110 may further comprise a release joint or tool 152 operable to selectively part or disconnect under controlled conditions. The release tool 152 may permit a portion of the tool string 110 connected below the release tool 152 to be left in the wellbore 120 while a portion of the tool string 110 located above the release tool 152 may be retrieved to the wellsite surface 105.

Coupled between the upper and lower portions 140, 150 of the tool string 110 is the downhole tool 200 operable to transmit tension from the upper portion 140 to the lower portion 150 while monitoring or detecting downhole the tension applied to the tool string 110 at the wellsite surface 105 via the conveyance means 160. As stated above, the tension transmitted from the tensioning device 170 via the conveyance means 160 may be affected by friction along the wellbore 120, especially in deviated and horizontal wellbores 120. Accordingly, measuring the tension at the wellsite surface 105 may be an unpredictable and often inaccurate indicator of actual tension applied to the cable head 142. Accordingly, the downhole tool 200 is operable to measure the tension applied to or otherwise experienced by the downhole tool 200 and, thus, the tool string 110. Although the downhole tool 200 is shown being implemented as a separate module or tool coupled along the tool string 110, it is to be understood that the downhole tool 200 may also be integrated into or implemented as a portion of the cable head 142 or the control tool 144.

Figure 3:
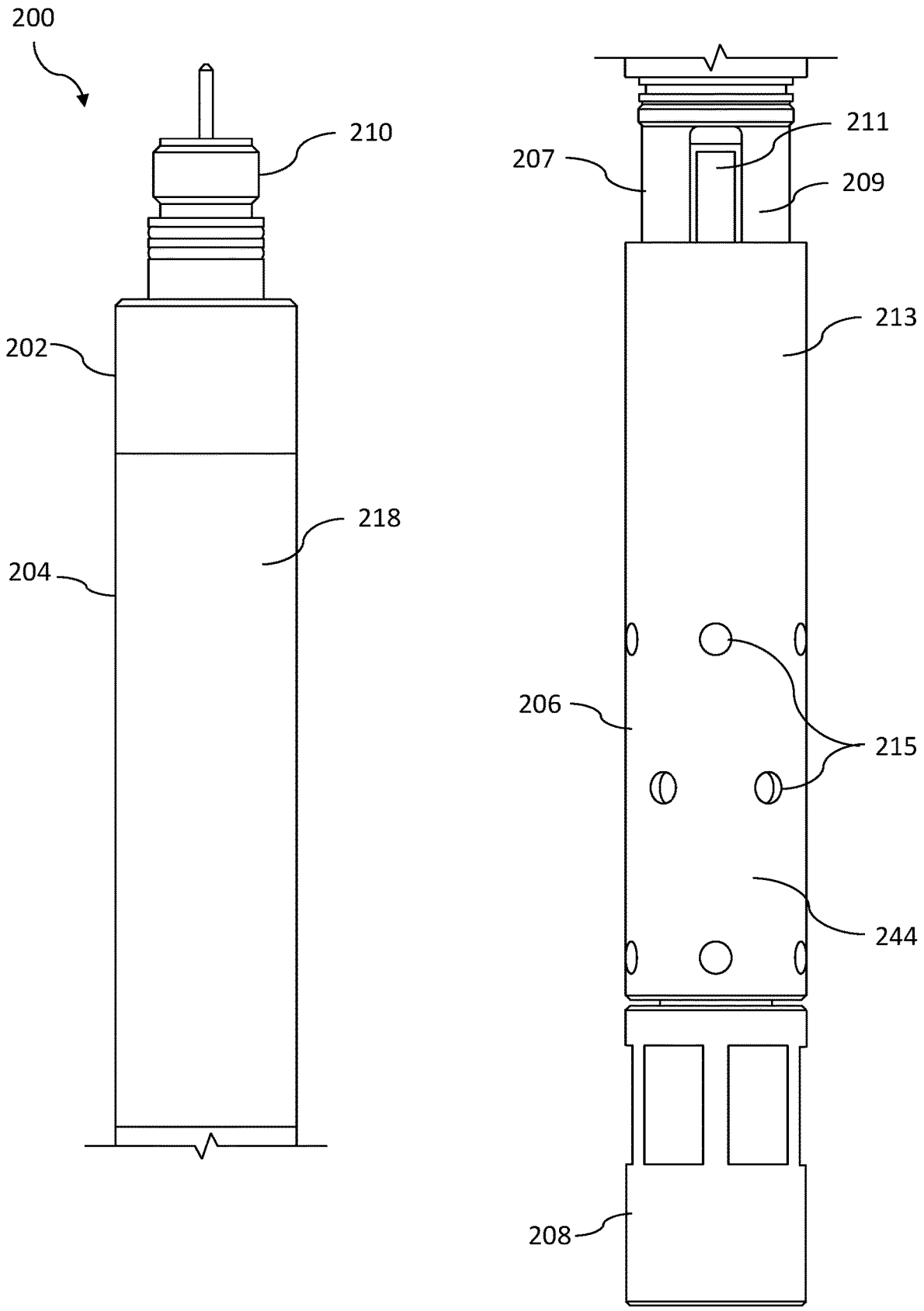
FIG. 3 is a side view of a portion of an example implementation of the apparatus shown in FIG. 2 according to one or more aspects of the present disclosure.

FIG. 3 is a side view of an example implementation of the downhole tool 200 shown in FIG. 2 according to one or more aspects of the present disclosure. The following description refers to FIGS. 1-3, collectively.

The downhole tool 200 may include an upper head 202, an electronics section or module 204, a power storage section or module 207, a load cell section or module 206, and a lower head 208, each having or defining one or more internal spaces, volumes, and/or bores for accommodating or otherwise containing various components of the downhole tool 200, including at least a portion of the electrical conductor 205 extending through the downhole tool 200. Although the downhole tool 200 is shown comprising a plurality of sections or modules coupled together, it is to be understood that the downhole tool 200 may be or comprise a single unitary tool.

The upper and lower heads 202, 208 of the downhole tool 200 may include interfaces, subs, and/or other means for mechanically and electrically coupling the downhole tool 200 with corresponding mechanical and electrical interfaces (not shown) of the upper and lower portions 140, 150 of the tool string 110.

The upper head 202 may be coupled with the electronics module 204. For example, a lower end of the upper head 202 may be coupled with an upper end of a housing 218 of the electronics module 204. Within the housing 218, the electronics module 204 may include various electronic components facilitating generation, reception, processing, recording, and/or transmission of electronic data, as well as distribution of electrical power to the electronic components.

Figure 4:
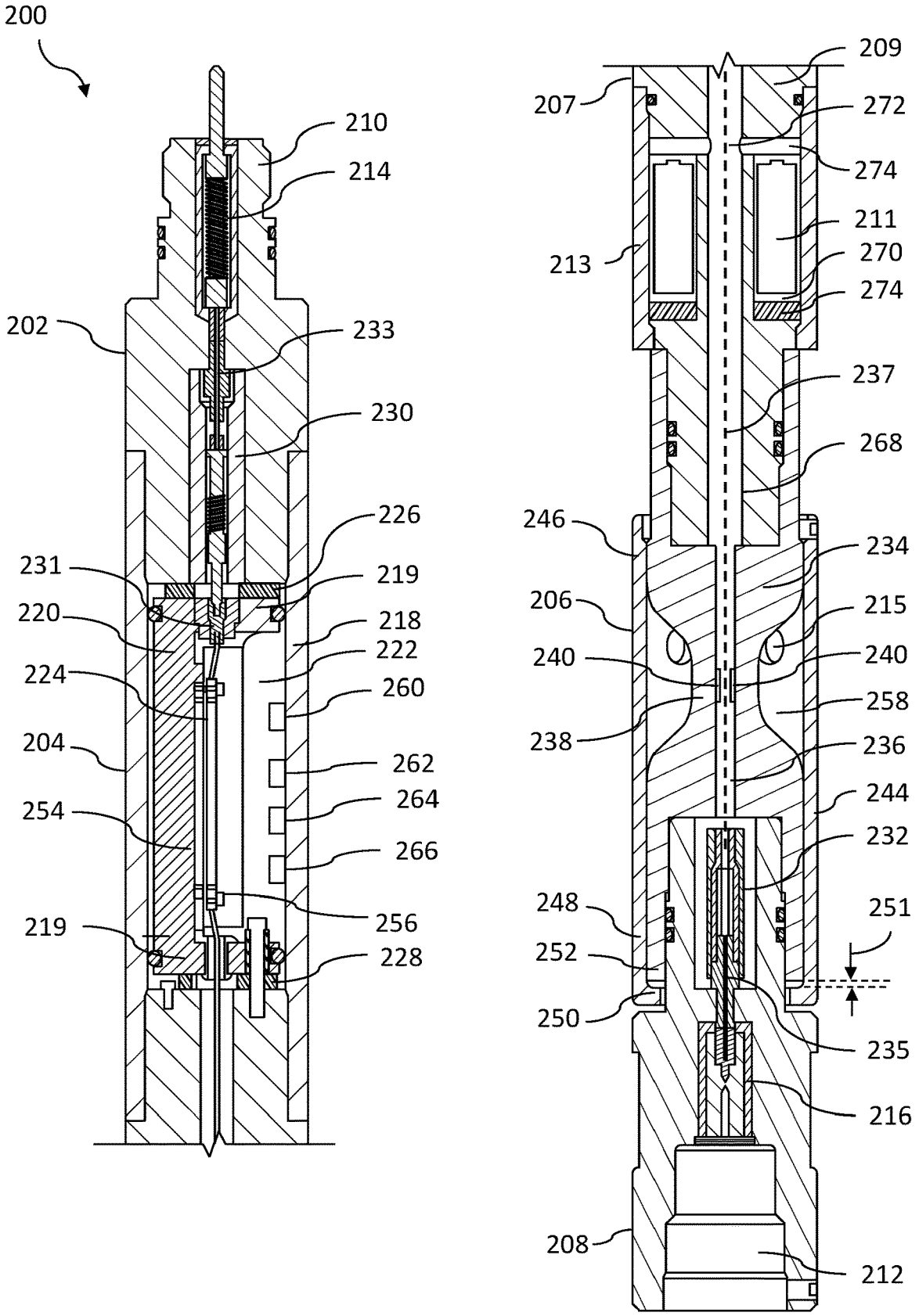
FIG. 4 is a sectional view of the apparatus shown in FIG. 3 according to one or more aspects of the present disclosure.

The electronics module 204 may be coupled with the power storage module 207. For example, a lower end of the housing 218 may be coupled with an upper end of a compartment portion 209 of the power storage module 207. The compartment portion 209 may be operable to accommodate therein one or more electrical energy storage devices 211, which may be or comprise one or more rechargeable batteries, such as lithium ion batteries, an electrical capacitor, and/or other means for storing electrical energy. The electrical storage devices 211 may be utilized to supply electrical power to the electronics module 204, including the electronic components and sensors located within the electronics module 204. The power storage module 207 may further comprise a sleeve 213 slidably disposed about at least a portion of the compartment portion 209 to selectively cover and uncover the electrical storage devices 211. When in the covered position, as shown in FIG. 4, the sleeve 213 may protect the electrical storage devices 211 and/or other portions of the power storage module 207. When in the uncovered position, as shown in FIG. 3, the sleeve 213 may facilitate access to the electrical storage devices 211 and/or other portions of the power storage module 207, such as during maintenance of the downhole tool 200 at the wellsite surface 105.

The power storage module 207 may be coupled with the load cell module 206. For example, a lower end of the compartment portion 209 may be coupled with an upper end of a tension-bearing portion 234 (shown in FIG. 4) of the load cell module 206. The load cell module 206 may include a sleeve 244 disposed about at least a portion of the tension-bearing portion 234. The sleeve 244 may comprise a plurality of openings 215 extending radially through a wall of the sleeve 244. A lower end of the tension-bearing portion 234 may be coupled with an upper end of the lower head 208 to couple the load cell module 206 with the lower head 208.

FIG. 4 is a sectional view of the downhole tool 200 shown in FIG. 3 according to one or more aspects of the present disclosure. The following description refers to FIGS. 1-4, collectively.

The upper head 202 of the downhole tool 200 may include a mechanical interface, a sub, and/or other means 210 for mechanically coupling the downhole tool 200 with a corresponding mechanical interface (not shown) of the upper portion 140 of the tool string 110. The interface means 210 may be integrally formed with or coupled to the upper head 202, such as via a threaded connection. The lower head 208 of the downhole tool 200 may include a mechanical interface, a sub, and/or other means 212 for mechanically coupling with a corresponding mechanical interface (not shown) of the lower portion 150 of the tool string 110. The interface means 212 may be integrally formed with or coupled to the lower head 208, such as via a threaded connection. Although the interface means 210, 212 are shown comprising an ACME pin and box couplings, respectively, the interface means 210, 212 may comprise other pin and box couplings, threaded connectors, fasteners, and/or other mechanical coupling means.

The upper interface means 210 and/or other portion of the upper head 202 may further include an electrical interface 214 comprising means for electrically connecting an electrical conductor 233 extending through the upper head 202 with a corresponding electrical interface (not shown) of the upper portion 140 of the tool string 110, whereby the corresponding electrical interface of the upper portion 140 may be in electrical connection with the electrical conductor 145. The lower interface means 212 and/or other portion of the lower head 208 may include an electrical interface 216 comprising means for electrically connecting an electrical conductor 235 extending through the lower head 208 with a corresponding interface (not shown) of the lower portion 150 of the tool string 110, whereby the corresponding electrical interface of the lower portion 150 may be in electrical connection with the electrical conductor 155. Although the electrical interfaces 214, 216 are shown comprising a pin and a receptacle, respectively, the electrical interfaces 214, 216 may each comprise other electrical coupling means, including plugs, terminals, conduit boxes, and/or other electrical connectors.

The upper head 202 may be threadedly or otherwise coupled with the housing 218 of the electronics module 204 to mechanically couple the electronics module 204 with the upper head 202. The housing 218 may define an internal space or volume 222, which may be operable to accommodate therein an electronics carrier or chassis 220 operable to carry or otherwise retain an electronic device, such as an electronics board 224. The chassis 220 may comprise one or more substantially planar mounting plates or surfaces 254 extending longitudinally within the internal volume 222 for accommodating the electronics board 224, which may be connected on the mounting surface 254 with one or more fasteners 256. The chassis 220 may comprise end portions 219 for permitting insertion of the chassis 220 into the internal volume 222, while minimizing radial movement within the internal volume 222 or otherwise maintaining the chassis 220 in a predetermined radial position with respect to the housing 218. The chassis 220 may have a sufficient thickness and/or strength to aid in preventing or minimizing flexing of the electronics board 224 during deployment, perforation, jarring, fishing, and/or other downhole operations, which may aid in preventing or minimizing physical damage to the electronics board 224. Damping members 226, 228 may be disposed on opposing sides of the chassis 220 to aid in damping and/or otherwise reducing shock transmitted to the electronics board 224 during deployment, perforation, jarring, fishing, and/or other downhole operations. The damping members 226, 228 may comprise rubber, polyether ether ketone (PEEK), silicone, VITON, potting material, and/or other damping material.

The electronics board 224 may comprise various electronic components facilitating generation, reception, processing, recording, and/or transmission of electronic data, as well as distribution of electrical power to the electronic components. The electronics board 224 may be in signal communication with a plurality of sensors, which may be operable to monitor various operational parameters associated with the downhole tool 200 during deployment, perforation, jarring, fishing, and/or other downhole operations. The electronics board 224 may also facilitate mounting of the sensors or the sensors may be mounted externally from the electronics board 224 and in signal communication with the electronics board 224 via electrical leads or other means. Output signals or information generated by the sensors may be communicated to the processing device for processing, recording to the memory device, and/or communication to the wellsite surface 105.

The downhole tool 200 may include a temperature sensor 260, such as a resistance temperature detector (RTD), which may be operable to generate a signal or information indicative of a temperature at a predetermined location. For example, the temperature sensor 260 may monitor the temperature within the electronics module 204 or within another portion of the downhole tool 200. The temperature sensor 260 may also monitor wellbore or ambient temperature external to the tool string 110. The temperature sensor 260 may be mounted to the housing 218 or another location within the downhole tool 200. Accordingly, the signal generated by the temperature sensor 260 may be utilized to monitor temperature changes within the downhole tool 200 and/or the wellbore 120 adjacent the tool string 110 caused by the perforation and/or plug setting operations, such as to determine whether the perforating tools 154 and/or the plug setting tool 156 were detonated or otherwise triggered.

The downhole tool 200 may include a pressure sensor 262, such as a strain gauge pressure sensor, which may be operable to generate a signal or information indicative of a pressure at a predetermined location. For example, the pressure sensor 262 may monitor the pressure within the electronics module 204 or within another portion of the downhole tool 200. The pressure sensor 262 may also monitor wellbore or ambient pressure external to the tool string 110. The pressure sensor 262 may be mounted to the housing 218 or another location within the downhole tool 200. Accordingly, the signal generated by the pressure sensor 262 may be utilized to monitor for transient pressure changes within the downhole tool 200 and/or the wellbore 120 adjacent the tool string 110 caused by the perforation and/or plug setting operations, such as to determine whether the perforating tools 154 and/or the plug setting tool 156 were detonated or otherwise triggered.

The downhole tool 200 may further include an accelerometer 264, which may be operable to generate a signal or information indicative of acceleration or shock imparted to the downhole tool 200. The accelerometer 264 may comprise a one, two, or three-axis accelerometer operable to measure axial and/or lateral acceleration and deceleration of the downhole tool 200. Implementations within the scope of the present disclosure may also comprise multiple instances of the accelerometer 264, including implementations in which each accelerometer 264 may detect a different range of acceleration. The accelerometer 264 may be mounted on the housing 218 of the electronics module 204, the electronics board 224, or the chassis 220. Accordingly, the signal generated by the accelerometer 264 may be utilized to monitor acceleration or mechanical shock imparted into downhole tool 200 from the lower portion 150 of the tool string 110 during the perforation and/or plug setting operations, such as to determine whether the perforating tools 154 and/or the plug setting tool 156 were detonated or otherwise triggered.

The downhole tool 200 may also include an acoustic sensor 266, such as a microphone or a piezoelectric acoustic transducer, which may be operable to generate a signal or information indicative of sound or acoustic waves traveling through the downhole tool 200. For example, the acoustic sensor 266 may monitor the sound or acoustic waves transmitted through the electronics module 204 or another portion of the downhole tool 200 during the perforation and/or plug setting operations. The acoustic sensor 266 may also monitor the sound or acoustic waves transmitted through a wellbore fluid external to the tool string 110 during the perforation and/or plug setting operations. The acoustic sensor 266 may be mounted to the housing 218 or another location within the downhole tool 200. Accordingly, the signal generated by the acoustic sensor 266 may be utilized to monitor for sound or acoustic waves caused by the perforation and/or plug setting operations, such as to determine whether the perforating tools 154 and/or the plug setting tool 156 were detonated or otherwise triggered.

The electronics board 224 may be electrically connected with or along one or more conductors extending between the upper and lower heads 202, 208, such as to permit communication of the electronic data and/or electrical power between the electronics board 224, the upper and lower portions 140, 150 of the tool string 110, and/or the surface equipment 175. Accordingly, each of the upper and lower heads 202, 208 may further comprise additional electrical interfaces 230, 232 facilitating electrical connection between the upper and lower heads 202, 208 and the electronics board 224. For example, the upper head 202 may comprise a lower electrical interface 230 having means for electrically connecting the electrical conductor 233 extending through the upper head 202 with a corresponding electrical interface 231 of the electronics module 204 electrically connected with the electronics board 224. Similarly, the lower head 208 may comprise an upper electrical interface 232 having means for electrically connecting the electrical conductor 235 extending through the lower head 208 with an electrical conductor 237 extending through the load cell module 206 and the power storage module 207 to the electronics board 224. Although the electrical interface 230 is shown comprising a pin connector and the electrical interfaces 231, 232 are shown comprising receptacles, the electrical interfaces 230, 231, 232 may comprise other electrical coupling means, including plugs, terminals, conduit boxes, and/or other electrical connectors. Although shown as a plurality of distinct components, the electrical conductors 233, 235, 237 along with the electrical interfaces 214, 216, 230, 231, 232 may collectively be or comprise at least a portion of the electrical conductor 205 described above and shown in FIGS. 1 and 2.

The housing 218 of the electronics module 204 may engage the power storage module 207 to couple the power storage module 207 with the electronics module 204. For example, a lower end of the housing 218 may be threadedly or otherwise coupled with an upper end of the compartment portion 209 of the power storage module 207. The compartment portion 209 may comprise an axial bore 268 for accommodating the electrical conductor 237 and the one or more cavities 270 for accommodating the electrical storage devices 211. Each cavity 270 may be connected with the axial bore 268 via a corresponding lateral bore 272, which may accommodate electrical leads or other conductors (not shown) extending between the electrical storage devices 211 and the electronics board 224 for transmitting electric power between the electrical storage devices 211 and the electronics board 224. Damping members 274 may be disposed within each cavity 270 on opposing sides of each electrical storage device 211, such as to dampen and/or reduce shock transmitted to the electrical storage devices 211 during deployment, perforation, jarring, fishing, and/or other downhole operations. The damping members 274 may comprise rubber, PEEK, and/or other damping material. The sleeve 213 of the power storage module 207 may be slidably disposed about the compartment portion 209 to selectively cover and uncover the electrical storage devices 211.

The compartment portion 209 of the energy storage module 207 may engage the load cell module 206 to couple the load cell module 206 with the energy storage module 207. For example, a lower end of the compartment portion 209 may be threadedly or otherwise coupled with an upper end of the tension-bearing portion 234 of the load cell module 206. The tension-bearing portion 234 may comprise a narrowed portion 238 and an axial bore 236 extending longitudinally through the tension-bearing portion 234. The axial bore 236 may accommodate the electrical conductor 237 and one or more load cell strain gauges 240 along an inner surface of the axial bore 236 adjacent the narrowed portion 238. The strain gauges 240 may be operable to generate signals indicative of the axial forces (i.e., tension or compression) applied to the narrowed portion 238 and, thus, downhole tool 200 and/or the tool sting 110. The axial bore 236 may further accommodate electrical leads or other conductors (not shown) extending between the strain gauges 240 and the electronics board 224 for transmitting the signals indicative of the axial forces to the electronics board 224. Each strain gauge 240 may be or comprise a Wheatstone bridge strain gauge.

A lower end of the tension-bearing portion 234 of the load cell module 206 may be threadedly or otherwise coupled with an upper end of the lower head 208 to couple the load cell module 206 with the lower head 208.

As the tool string 110 is conveyed or otherwise disposed along the wellbore 120, the housing 218 of the electronics module 204 transmits tension applied to the upper head 202 to the tension-bearing portion 234, while the lower head 208 transmits weight of the lower portion 150 of the tool string 110, including the perforating tools 154 and the plug 158, to the tension-bearing portion 234. As shown in FIG. 4, the narrowed portion 238 of the tension-bearing portion 234 may be substantially narrower than other portions of the tension-bearing portion 234, resulting in substantially greater stress concentrations and, thus, strain, at the narrowed portion 238. Accordingly, the tension applied to the upper head 202 and the weight applied to the lower head 208 may cause the tension-bearing portion 234 to strain (i.e., stretch) at the narrowed portion 238. Because a cross-sectional area of the narrowed portion 238 is known, the strain measured by the strain gauges 240 may be utilized to determine the axial forces applied to or experienced by the narrowed portion 238 and, thus, the downhole tool 200 by the tensioning device 170 and/or the weight of the lower portion 150 of the tool string 110.

The signals generated by the strain gauges 240 may also be utilized to monitor axial forces that may be imparted to the downhole tool 200 during the perforation and/or plug setting operations, such as to determine whether the perforating tools 154 and/or the plug setting tool 156 were detonated or otherwise triggered. For example, substantial spikes or fluctuations in the axial forces applied to or experienced by the narrowed portion 238 of the load cell module 206 may be indicative of detonation of the perforating tools 154 and/or the plug setting tool 156. Furthermore, a substantial fluctuation in tension may be indicative of the plug 158 being successfully set within the wellbore 120 and detached from the tool string 110.

The load cell module 206 may further include a sleeve 244 disposed about at least a portion of the tension-bearing portion 234, including the narrowed portion 238. An upper portion 246 of the sleeve 244 may be threadedly or otherwise coupled with the tension-bearing portion 234 above the narrowed portion 238, while a lower portion 248 of the sleeve 244 may be slidably disposed about the tension-bearing portion 234 below the narrowed portion 238. The lower portion 248 of the sleeve 244 may comprise an inwardly extending shoulder or another engaging feature 250 separated from an outwardly extending shoulder or another engaging feature 252 of the tension-bearing portion 234 by an axially extending gap or space 251. Accordingly, the sleeve 244 may limit bending of the tension-bearing portion 234 at the narrowed portion 238 and, thus, prevent or reduce false tension readings and/or protect the narrowed portion 238 from excessive lateral or bending loads. However, the sleeve 244 may not support axial loads, unless sufficiently high axial loads are applied to the tool string 110 to cause the narrowed portion 238 to stretch such that the engaging feature 250 of the sleeve 244 contacts or engages the engaging feature 252 of the tension-bearing portion 234. Axial loads that may cause the engaging features 250, 252 to contact may be encountered, for example, during jarring and/or fishing operations. The sleeve 244 may also protect the tension-bearing portion 234 against bending when the downhole tool 200 is picked up from horizontal to vertical, set down, or otherwise handled at the wellsite surface 105. The openings 215 extending radially through the sleeve 244 may permit pressurized water or cleaning fluids to be injected into an internal space or volume 258 between the tension-bearing portion 234 and the sleeve 244 at the wellsite surface 105 to wash away formation particles and/or other debris that may become trapped between the tension-bearing portion 234 and the sleeve 244 while downhole.

The downhole tool 200 described herein and shown in FIGS. 3 and 4 is oriented such that the load cell module 206 is located below the electronics module 204. However, it is to be understood that the orientation of the downhole tool 200 within the tool string 110 may be reversed 180 degrees, such that the load cell module 206 is located above the electronics module 204, without affecting the operation of the downhole tool 200.

Figure 5:
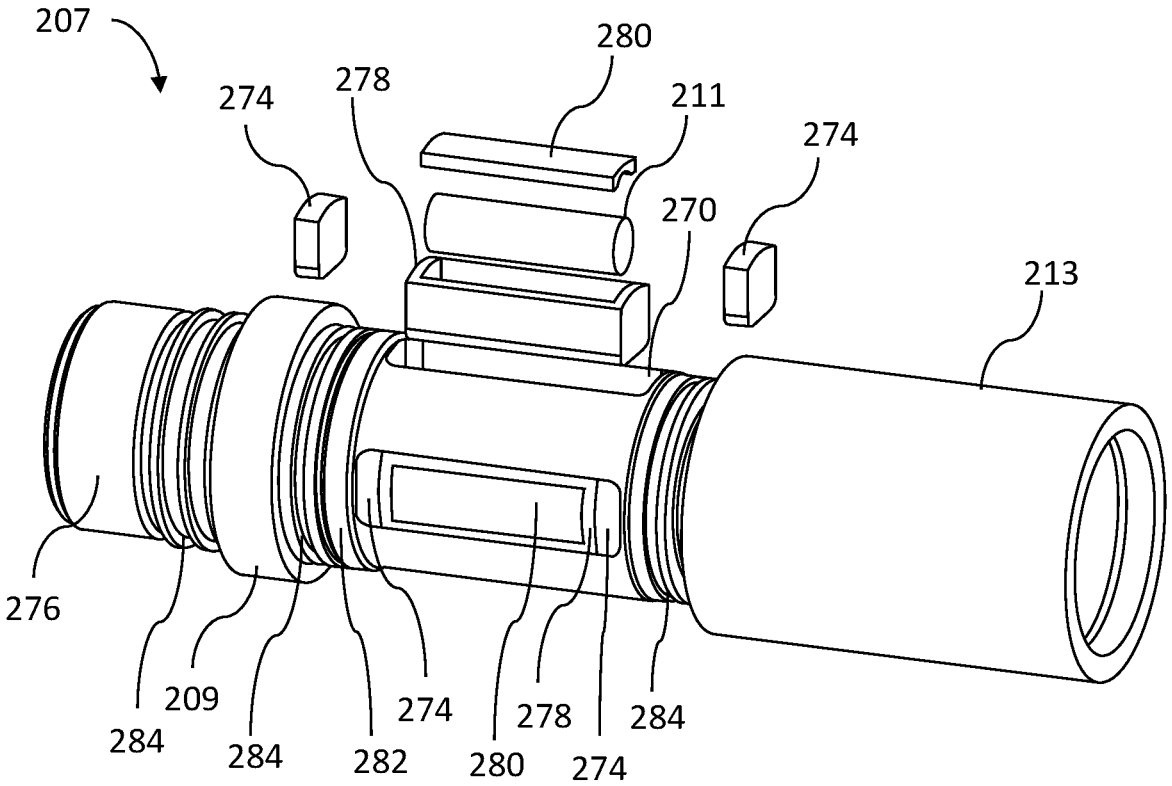
FIG. 5 is an exploded perspective view of a portion of the apparatus shown in FIGS. 3 and 4 according to one or more aspects of the present disclosure.

FIG. 5 is an exploded perspective view the power storage module 207 shown in FIGS. 3 and 4 according to one or more aspects of the present disclosure. The following description refers to FIG. 3-5, collectively.

One end of the compartment portion 209 may comprise a threaded portion 276 for threadedly engaging a corresponding threaded portion of the electronics module 204, while an opposing end of the compartment portion 209 may also comprise a threaded portion (obstructed from view) for threadedly engaging a corresponding threaded portion of the load cell module 206. The compartment portion 209 may include one or more cavities 270 extending into the compartment portion 209, wherein each cavity 270 may be operable to accommodate one or more electrical storage devices 211. Each electrical storage device 211 may be enclosed or otherwise disposed within a corresponding enclosure 278 and cover 280, which may collectively electrically insulate the electrical storage device 211 from sidewalls of the cavity 270. The damping members 274 may be disposed within each cavity 270 between the enclosure 278 and the sidewalls of the cavity 270 to aid in damping and/or reducing shock transmitted to the electrical storage devices 211. The electrical storage devices 211 may be retained within the corresponding cavities 270 by the sleeve 213 slidably disposed about the compartment portion 209, including the cavities 270. The sleeve 213 may be retained in the covered position by engaging a threaded portion (obstructed from view) of the sleeve 213 with a corresponding threaded portion 282 of the compartment portion 209. The compartment portion 209 may further include a plurality of circumferential grooves 284 for retaining fluid seal elements (not shown) for fluidly sealing internal portions of the downhole tool 200, including the power storage module 207, from the wellbore fluid.

Figure 6:
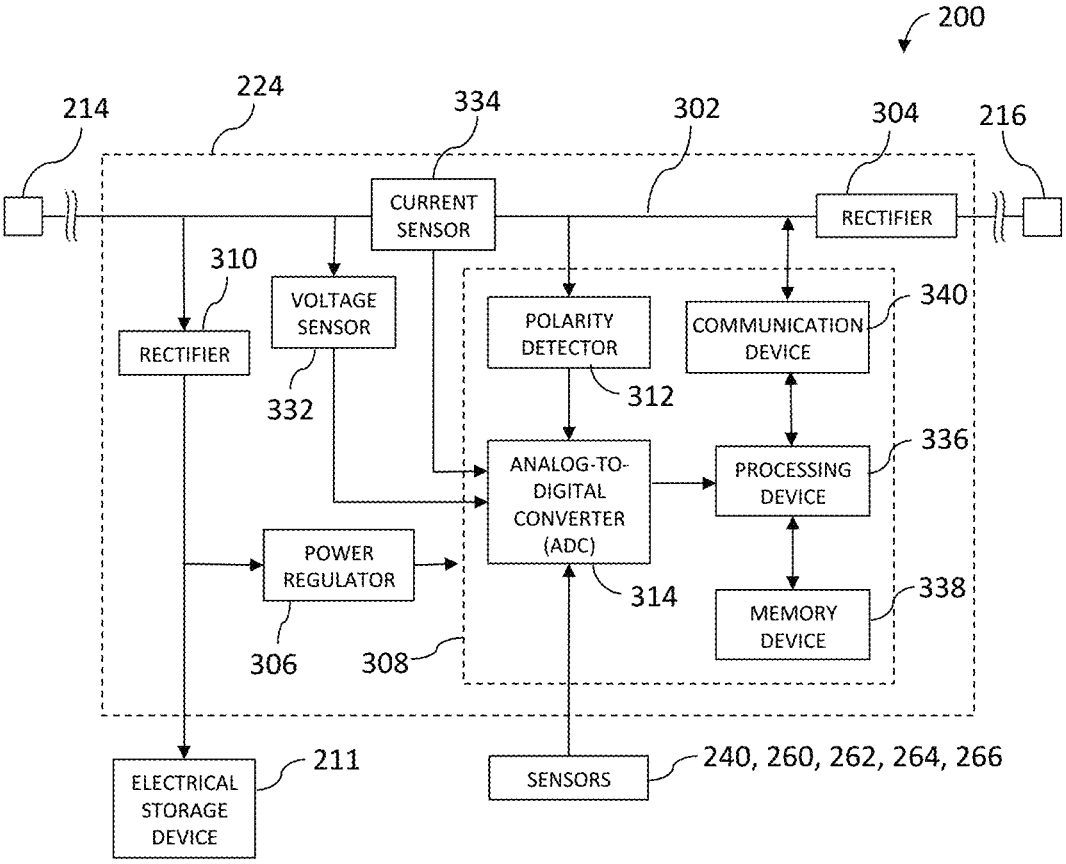
FIG. 6 is a schematic view of a portion of an example implementation of the apparatus shown in FIG. 4 according to one or more aspects of the present disclosure.

FIG. 6 is a schematic view of at least a portion of an example implementation of the electronics board 224 shown in FIG. 4 according to one or more aspects of the present disclosure. The following description refers to FIGS. 1-6, collectively.

The electronics board 224 may comprise a bus or electrical conductor 302 connected along or forming at least a portion of the electrical conductor 205. One side of the electrical conductor 302 may be electrically connected with the electrical interface 214 of the upper head 202 via the electrical conductor 233 and the electrical interfaces 230, 231, while an opposing side of the electrical conductor 302 may be electrically connected with the electrical interface 216 of the lower head 208 via the electrical conductors 235, 237 and the electrical interface 232.

The electronics board 224 may comprise various electronic components, which may be electrically connected in series or parallel with the electrical conductor 302 via one or more electrical conductors. The electronic components may be powered with a voltage supplied from the power and control system 172 at the wellsite surface 105 via the conveyance means 160 and the electrical conductors 145, 155, 205, including the electrical conductor 302. Similarly, other components of the tool string 110, including the perforating tools 154 and plug setting tool 156, may also be powered with the voltage supplied from the wellsite surface 105. Mass (e.g., the housing 218, the upper head 202) of the downhole tool 200 and/or other portions of the tool string 110 may operate as a portion of a power line or a return line. If one or more portions of the electrical conductors 145, 155, 205 comprise an armor and/or multiple electrical conductors (both of which are not shown), the return line may also or instead be along the armor and/or one or more of the multiple electrical conductors.

In an example implementation of the wellsite system 100, negative polarity voltage may be supplied from the wellsite surface 105 to the upper electrical interface 214 and, thus, the electrical conductor 302 during certain downhole operations, such as during conveyance of the tool string 110. However, during other downhole operations, such as during detonation or triggering of the perforating tools 154 and/or the setting tool 156, a positive polarity voltage may be supplied from the wellsite surface 105. The former operational configuration is referred to hereinafter as a "correlation mode," while the latter operational configuration is referred to hereinafter as a "detonation mode."

An electrical rectifier 304 may be connected in series with or along the electrical conductor 302. In an example implementation, the rectifier 304 may be oriented or otherwise operable to pass positive voltage from the upper electrical interface 214 to the lower electrical interface 216 and, thus, pass positive voltage to the perforating tools 154, the plug setting tool 156, or another portion of the tool string 110 connected below the downhole tool 200 during the detonation mode. Hence, the rectifier 304 may block negative voltage at the upper electrical interface 214 from reaching the lower electrical interface 216. The rectifier 304 may be or comprise, for example, one or more diodes connected in series or otherwise connected to pass the positive voltage and block the negative voltage from the upper electrical interface 214 to the lower electrical interface 216.

The electronics board 224 may include a power regulator 306 for supplying electrical power (i.e., head voltage) to several electronic components 308. The voltage supplied to the power regulator 306 may pass through a rectifier 310, which, in an example implementation, may be oriented or otherwise operable to pass negative voltage from the electrical conductor 302 to the power regulator 306 during the correlation mode to power up the electronic components 308. During the detonation mode, the rectifier 310 may fully rectify or reverse the positive voltage applied to the electrical conductor 302 to a negative voltage to supply the negative voltage to the power regulator 306 to power up the electronic components 308. Accordingly, the rectifier 310 facilitates operation of the electronic components 308 during both the correlation and detonation modes. The rectifier 310 may be or comprise, for example, four or more diodes connected in a full-bridge configuration.

The electrical storage device 211 may be electrically connected with the electrical conductor 302 in series with the rectifier 310. The electrical storage device 211 may be operable to store electrical power supplied to the electrical storage device 211 at the wellsite surface 105 and/or the electrical storage device 211 may store electrical power supplied to the electrical storage device 211 via the rectifier 310 while downhole. The electrical storage device 211 may also be electrically connected with the power regulator 306 to supply electrical power to the electronic components 308.

When the perforating tools 154 and/or the setting tool 156 are detonated or triggered, the wellbore fluid may flood one or more of the perforating tools 154 and/or the setting tool 156 and short out the electrical conductor 155 or another electrical conductor with the mass of the tool string 110, and at least temporarily stop providing power to the electronic components 308. Accordingly, the electrical storage device 211 may supply electrical power to the electronic components 308 when, for example, insufficient voltage or no voltage is applied to the electrical conductor 302 after the perforating tools 154 and/or the setting tool 156 are detonated. Each of the electrical storage device 211 and the power regulator 306 may also be electrically connected to ground or the return line, which may be or comprise the chassis 220 and/or other portions of the mass of the downhole tool 200.

The downhole tool 200 may also be implemented such that the electronic components 308 are powered by the electrical storage device 211 throughout the detonation mode, regardless whether the electrical conductor 302 is supplied with voltage. For example, the rectifier 310 may be or comprise one or more diodes connected in series or otherwise connected to pass the negative voltage from the electrical conductor 302 to the electrical storage device 211 and the power regulator 306 to power up the electronic components 308 during the correlation mode. However, the diodes may not reverse the polarity of the positive voltage applied to the electrical conductor 302 during the detonation mode, just block the positive voltage from reaching the power regulator 306 and the electronic components 308. Because such configuration does not permit voltage to be supplied from the electrical conductor 302 during the detonation mode, voltage stored in the electrical storage device 211 may be supplied to the power regulator 306 to power up the electronic components 308. Accordingly, the electrical components 308 are isolated from the electrical conductor 302 by the rectifier 310 when in the detonation mode. Such configuration enhances safety, as the perforating tools 154 and the plug setting tool 156 are isolated from the electronic components 308.

The voltage at the electrical conductor 302 may also be applied to a polarity detector 312, which may facilitate detection of the polarity of the electrical conductor 302 to detect whether the wellsite system 100 is in the correlation or detonation mode. Accordingly, the polarity detector 312 may output a voltage detection signal indicative of the polarity of the electrical conductor 302 to an analog-to-digital converter (ADC) 314.

Figure 7:
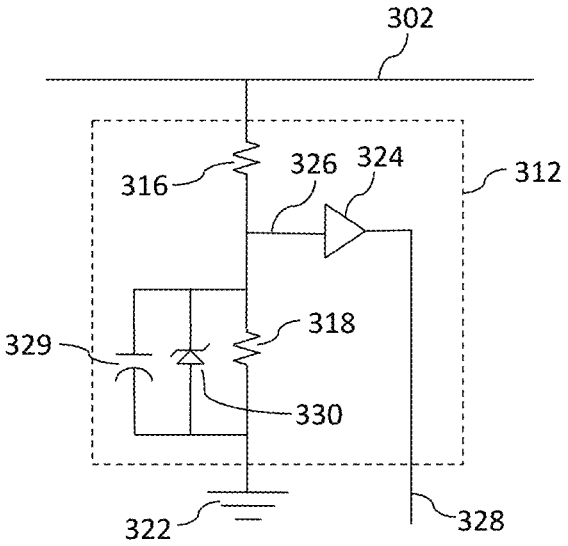
FIG. 7 is a schematic view of a portion of an example implementation of the apparatus shown in FIG. 6 according to one or more aspects of the present disclosure.

FIG. 7 is a schematic view of at least a portion of an example implementation of the polarity detector shown in FIG. 6 according to one or more aspects of the present disclosure. Referring to FIGS. 6 and 7, collectively, the polarity detector 312 may include two resistors 316, 318 connected in series between the electrical conductor 302 and ground 322. The polarity detector 312 may further include a comparator 324 having an input 326 center tapped between the resistors 316, 318 and an output 328 connected with the ADC 314. The polarity detector 312 may further include a capacitor 329 and/or a zener diode 330 connected in parallel with the resistor 318 and in series with the resistor 316 to protect the comparator 324 and/or the ADC 314 from harmful voltages and transients.

Although the wellsite system 100, including the tool string 110, is described herein as supplying and/or utilizing negative polarity voltage to power the upper portion 140 of the tool string 110 and the downhole tool 200 during the correlation mode and positive polarity voltage to power the perforating tools 154 and the plug setting tool 156 during the detonation mode, it is to be understood that the wellsite system 100, including the tool string 110, may supply and/or utilize negative polarity voltage to power the perforating tools 154 and the plug setting tool 156 during the detonation mode and positive polarity voltage to power the upper portion 140 of the tool string 110 and the downhole tool 200 during the correlation mode. Accordingly, the rectifier 304 may be operable to permit passage of the negative polarity voltage to the perforating tools 154 and the plug setting tool 156, and the rectifier 310 may be operable to permit passage of the positive polarity voltage or reverse the negative polarity voltage to the positive polarity voltage to power up the electronic components 308.

Referring again to FIGS. 1-6, the electronics board 224 or another portion of the downhole tool 200 may further include a voltage and/or current sensors 332, 334 operable to generate signals or information indicative of the voltage and current, respectively, along the electrical conductor 302 or another portion of the electrical conductor 205. Changes in voltage and/or current in the electrical conductor 205 may be indicative of whether the perforating tools 154 and/or the plug setting tool 156 were detonated or otherwise triggered. For example, when the perforating tools 154 and/or the plug setting tool 156 are detonated, the electrical conductor 155 may be shorted out with the mass of the lower portion 150 or another portion of the tool string 110. A short circuit of the electrical conductor 155 may, for example, cause the voltage of the electrical conductor 205 to fluctuate and/or drop to zero value, which may be indicative that the perforating tools 154 and/or the plug setting tool 156 were triggered. A short circuit of the electrical conductor 155 may, for example, cause the current through the electrical conductor 205 to fluctuate and/or momentarily spike, which may be indicative that the perforating tools 154 and/or the plug setting tool 156 were triggered.

The voltage sensor 332 may be connected in parallel with the electrical conductor 205 while the current sensor 334 may be electrically connected in series along the electrical conductor 205. For example, the voltage sensor 332 may be operable to measure voltage across a resistive divider (not shown) connected in parallel with the electrical conductor 302, while the current sensor 334 may be operable to measure current through a low-resistance resistor (not shown) connected in series with the electrical conductor 302. The current sensor 334 may also include a Hall effect sensor, which may measure the current along the electrical conductor 205 by measuring a magnetic field generated by the electrical current along the electrical conductor 205.

The sensors 240, 260, 262, 264, 266, 332, 334 described above, which are collectively referred to hereinafter as "tool sensors," may be electrically connected with the ADC 314 to communicate the signal or information generated by each of the tool sensors to the ADC 314 to be converted from analog form to digital form. One or more of the tool sensors may include or be electrically connecter with a corresponding excitation or driver circuit (not shown) for powering the tool sensors. One or more of the tool sensors may also include or be electrically connected with a corresponding signal amplifier (not shown) for increasing the amplitude of the signal generated by the tool sensors for communication to the ADC 314. The digitized signals may then be received and processed by a processing device 336.

The processing device 336 may be, comprise, or be implemented by one or a plurality of processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processing device 336 may be in communication with a memory device 338, such as may include a volatile memory and a non-volatile memory. The volatile memory may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory may be, comprise, or be implemented by read-only memory, flash memory, and/or other types of memory devices.

The memory device 338 may be operable to store or record coded instructions, information entered by the human operators, and/or data received from the processing device 336. Such data may include information indicative of the tension applied to the downhole tool 200 and/or whether the perforating tools 154 and/or the plug setting tool 156 were detonated or otherwise triggered. The data may also include the signals or information generated by the tool sensors. The data may be retrieved from the memory device 338 when the downhole tool 200 is retrieved to the wellsite surface 105, or the data may be retrieved from the memory device 338 and transmitted to the wellsite surface 105 while the downhole tool 200 is downhole via a communication device 340.

The communication device 340 may be or comprise a telemetry driver operable for communication with the power and control system 172 or another portion of the surface equipment 175. The telemetry driver may be operable, for example, to vary or modulate the current through the electrical conductor 302 to transmit the data via the electrical conductors 302, 205, 145 and the conveyance means 160 to the wellsite surface 105 in the form of current frequency variations. The frequency range of the telemetry driver may be selected to occupy a different frequency band from the correlation tool or other control tools 144 of the tool string 110. The modulated signal may be monitored at the wellsite surface 105 and displayed and/or recorded by the memory device 177 or another portion of the power and control system 172. Accordingly, the processing device 336 may output the data directly to the communication device 340 for real-time transmission to the surface, or the processing device 336 may retrieve the data stored in the memory device 338 for transmission to the wellsite surface when intended, such as during the correlation mode.

The modulated signal may be communicated to a tensioning device controller (not shown) or otherwise utilized at the wellsite surface 105 to control the tensioning device 170, such as to facilitate dynamic or real-time control of the tensioning device 170 in response to variations in tension at the tool string 110. The modulated signal may also be converted to an audio signal via an acoustic speaker (not shown) to provide a tensioning device operator with audio feedback as the tool string 110 is being conveyed within the wellbore 120.

The processing device 336 may comprise a local memory (not shown) and may execute coded instructions present in the local memory and/or another memory device. The coded instructions may include machine-readable instructions or computer program code that, when executed by the processing device 336, may cause the processing device 336 and/or another portion of the downhole tool 200 or the wellsite system 100 to perform methods and processes described herein. For example, the processing device 336 may be operable to detect polarity of the voltage supplied to the tool string 110 from the wellsite surface 105, convert the analog signals received from the tool sensors to digital signals with the ADC 314, and compile data, which may include the signals or information generated by the tool sensors, information indicative of the tension applied to the downhole tool 200, and/or information indicative of whether the perforating tools 154 and/or the plug setting tool 156 were detonated or otherwise triggered. The processing device may be further operable to output the data to the communication device 340 for transmission to the wellsite surface 105 and/or output the data to the memory device 338 to be recorded.

In view of the entirety of the present disclosure, including the figures and the claims, a person having ordinary skill in the art should readily recognize that the present disclosure introduces an apparatus comprising: (1) a downhole measurement tool for coupling between opposing first and second portions of a downhole tool string, wherein the downhole tool comprises one or more of: (a) a load cell connected along a tension-bearing member of the downhole tool and operable to generate a signal indicative of tension applied to the downhole tool; and (b) an electronic device operable to receive the signal indicative of the tension; and (2) a perforating tool for coupling within the tool string and operable to perforate at least a portion of a subterranean formation surrounding a wellbore.

The electronic device may be operable to transmit the signal indicative of the tension to a wellsite surface.

The electronic device may be operable to record the signal indicative of the tension to a memory device in the downhole tool.

The downhole tool may further comprise: a first coupling at a first end of the downhole tool and operable for mechanically and electrically connecting the first end of the downhole tool to the first portion of the tool string; and a second head at a second end of the downhole tool and operable for mechanically and electrically connecting the second end of the downhole tool to the second portion of the tool string.

The downhole tool may further comprise: an electronics module comprising the electronic device; and a load cell module comprising the tension-bearing member and the load cell. The electronics module may comprise: a housing; a chassis disposed within the housing; and an electronics board connected to the chassis. The electronics board may be or comprise the electronic device. The tension-bearing member may be operable to bear the tension applied to the downhole tool, the tension-bearing member may comprise a narrowed portion operable to stretch when the tension is applied to the downhole tool, and the load cell may be connected to a surface of the narrowed portion. The downhole tool may further comprise a sleeve disposed at least partially about the tension-bearing member, wherein the sleeve may be fixedly connected to a first portion of the tension-bearing member on one side of the narrowed portion, and wherein the sleeve may be slidably disposed about a second portion of the tension-bearing member on an opposing side of the narrowed portion.

The electronic device may operate on a voltage having a negative polarity.

The downhole tool may further comprise an electronics board comprising the electronic device, and the electronics board may be electrically powered by a voltage having a first polarity. The electronics board may be electrically connected to an electrical power source with a rectifier connected in series between the electronics board and the electrical power source to pass the voltage having the first polarity to the electronics board and to block a voltage having a second polarity from reaching the electronics board.

The downhole tool may further comprise a sensor operable to generate a signal indicative of detonation of the perforating tool downhole, and the electronic device may be operable to receive the signal indicative of the detonation. The sensor may comprise at least one of a temperature sensor, a pressure sensor, an accelerometer, an acoustic sensor, a voltage sensor, and a current sensor. The electronic device may be operable to transmit the signal indicative of the detonation to a wellsite surface. The electronic device may be operable to record the signal indicative of the detonation to a memory device.

The present disclosure also introduces a method comprising: (1) applying tension to a tool string to convey the tool string within a wellbore, wherein the tool string comprises: (a) a downhole tool coupled between first and second portions of the tool string, wherein the downhole tool comprises: (i) a load cell connected along a tension-bearing member of the downhole tool; and (ii) a processing device; and (b) a perforating tool operable to perforate at least a portion of a subterranean formation surrounding a wellbore; and (2) operating the downhole tool to cause: (a) the load cell to generate a signal indicative of the tension applied to the tool string; and (b) the processing device to receive, process, and output data indicative of the tension applied to the tool string.

The method may further comprise operating the perforating tool to perforate at least the portion of the subterranean formation surrounding the wellbore.

The method may further comprise operating the downhole tool to cause the processing device to output the data indicative of the tension to a memory device within the downhole tool.

The method may further comprise operating the downhole tool to cause the processing device to transmit the data indicative of the tension to a wellsite surface.

The downhole tool may further comprise an analog-to-digital converter (ADC) and a communication device, and operating the downhole tool may further comprise operating the downhole tool to cause the processing device to: convert the signal indicative of the tension generated by the load cell from an analog form to a digital form with the ADC; compile the data indicative of the tension applied to the tool string; and output the data to the communication device for transmission to a wellsite surface.

The downhole tool may further comprise a sensor, and operating the downhole tool may further comprise operating the downhole tool to cause: the sensor to generate a signal indicative of detonation of the perforating tool downhole; and the processing device to receive, process, and output data indicative of detonation of the perforating tool downhole. The method may further comprise operating the downhole tool to cause the processing device to output the data indicative of the detonation to a memory device within the downhole tool. The method may further comprise operating the downhole tool to cause the processing device to transmit the data indicative of the detonation to a wellsite surface.

Operating the downhole tool may further comprise operating the downhole tool on a voltage having a negative polarity.

Operating the downhole tool may further comprise: applying a voltage having a first polarity to the downhole tool from the wellsite surface when conveying the tool string within the wellbore; applying a voltage having a second polarity to the downhole tool from the wellsite surface when detonating the perforating tool within the wellbore; operating the downhole tool to block the voltage having the second polarity from reaching the processing device; and operating the downhole tool to supply the voltage having the first polarity to the processing device from an electrical storage device when applying the voltage having the second polarity to the downhole tool from the wellsite surface.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

The invention claimed is:

1. An apparatus comprising:

a measurement tool for coupling between first and second portions of a tool string conveyable within a wellbore that extends into a subterranean formation, wherein the second tool string portion comprises a perforating tool, and wherein the measurement tool comprises:

a sensor operable to generate information;

electronic components electrically connected with the sensor and operable to:

record the information; or transmit the information to surface equipment located at a wellsite surface from which the wellbore extends; or record the information and transmit the information to the surface equipment;

a first rectifier operable to:

permit passage to the perforating tool of electrical power having a first polarity transmitted from a first component of the surface equipment to electrically power the perforating tool; and prevent passage to the perforating tool of electrical power having a second polarity opposite of the first polarity transmitted from a second component of the surface equipment; and a second rectifier operable to:

permit passage to the electronic components of the electrical power having the second polarity transmitted from the second component of the surface equipment to electrically power the electronic components; and prevent passage to the electronic components of electrical power having the first polarity transmitted from the first component of the surface equipment.

2. The apparatus of claim 1 wherein the measurement tool further comprises:

a first electrical connector operable to electrically connect the measurement tool with the first tool string portion;

a second electrical connector operable to electrically connect the measurement tool with the second tool string portion;

a first electrical line extending between the first and second electrical connectors, wherein the first rectifier is connected along the first electrical line; and a second electrical line connected with the first electrical line, wherein the second rectifier is connected along the second electrical line, and wherein the electronic components are connected with and operable to receive, via the second electrical line, the electrical power having the second polarity transmitted from the second component of the surface equipment.

3. The apparatus of claim 2 wherein the second electrical line is connected with the first electrical line between the first electrical connector and the first rectifier.

4. The apparatus of claim 1 wherein the measurement tool further comprises an electrical storage device operable to supply the electrical power having the second polarity to the electronic components to electrically power the electronic components and the sensor while the electrical power having the first polarity is transmitted from the first component of the surface equipment to electrically power the perforating tool.

5. The apparatus of claim 4 wherein the sensor is operable to generate information indicative of detonation of the perforating tool while the electrical storage device supplies the electrical power having the second polarity to the electronic components.

6. The apparatus of claim 5 wherein the sensor is or comprises a load cell operable to generate information indicative of tension applied to the measurement tool.

7. The apparatus of claim 5 wherein the electronic components are operable to record the information indicative of detonation of the perforating tool while the electrical storage device supplies the electrical power having the second polarity to the electronic components.

8. The apparatus of claim 1 wherein the measurement tool further comprises an electrical storage device electrically connected with the electronic components and operable to:

store the electrical power having the second polarity passed by the second rectifier while the electrical power having the second polarity is transmitted from the second component of the surface equipment; and supply the stored electrical power having the second polarity to the electronic components to electrically power the electronic components and the sensor while the electrical power having the first polarity is transmitted from the first component of the surface equipment.

9. The apparatus of claim 1 wherein each of the first and second rectifiers comprises one or more diodes.

10. The apparatus of claim 1 wherein the second rectifier is further operable to reverse polarity of the electrical power having the first polarity to the electrical power having the second polarity to electrically power the electronic components and the sensor while the electrical power having the first polarity is transmitted from the first component of the surface equipment.

11. The apparatus of claim 10 wherein the sensor is operable to generate information indicative of detonation of the perforating tool while the second rectifier reverses polarity of the electrical power having the first polarity to the electrical power having the second polarity to electrically power the electronic components and the sensor.

12. The apparatus of claim 11 wherein the sensor is or comprises a load cell operable to generate information indicative of tension applied to the measurement tool.

13. The apparatus of claim 11 wherein the electronic components are operable to record the information indicative of detonation of the perforating tool while the second rectifier reverses polarity of the electrical power having the first polarity to the electrical power having the second polarity to electrically power the electronic components and the sensor.

14. The apparatus of claim 1 wherein the electronic components comprise a polarity detector operable to detect polarity of the electrical power transmitted from the first and second components of the surface equipment.

15. A method comprising:

conveying a tool string within a wellbore that extends into a subterranean formation, wherein the tool string comprises:

a measurement tool comprising electronic components; and a perforating tool located downhole from the measurement tool and operable to perforate the subterranean formation;

transmitting from a first component of surface equipment to the tool string electrical power having a first polarity to electrically power the electronic components while:

the measurement tool prevents passage of the electrical power having the first polarity to the perforating tool; and the electronic components operate via the electrical power having the first polarity;

transmitting from a second component of the surface equipment to the tool string electrical power having a second polarity to electrically power the perforating tool while the measurement tool prevents passage of the electrical power having the second polarity to the electronic components; and operating the perforating tool while transmitting from the second component of the surface equipment to the tool string the electrical power having the second polarity.

16. The method of claim 15 wherein the measurement tool further comprises a sensor electrically connected with the electronic components, and wherein the method further comprises, while transmitting from the second component of the surface equipment to the tool string the electrical power having the second polarity:

reversing polarity of the electrical power having the second polarity to electrical power having the first polarity to electrically power the electronic components and the sensor; and operating the electronic components and the sensor while reversing the polarity of the electrical power having the second polarity to electrical power having the first polarity.

17. The method of claim 16 wherein operating the sensor comprises generating information indicative of detonation of the perforating tool.

18. The method of claim 17 wherein operating the electronic components comprises recording the information indicative of the perforating tool detonation.

19. The method of claim 16 wherein the sensor is or comprises a load cell, and wherein operating the sensor comprises generating information indicative of tension applied to the measurement tool.

20. The method of claim 15 wherein:

the measurement tool further comprises:

a sensor electrically connected with the electronic components; and an electrical storage device electrically connected with the electronic components; and the method further comprises, while transmitting from the second component of the surface equipment to the tool string the electrical power having the second polarity:

supplying the electrical power having the first polarity from the electrical storage device to the electronic components to electrically power the electronic components and the sensor; and operating the electronic components and the sensor via the electrical power having the first polarity from the electrical storage device.

21. The method of claim 20 wherein the method further comprises, while transmitting from the first component of the surface equipment to the tool string the electrical power having the first polarity, storing the electrical power having the first polarity in the electrical storage device.

22. A method comprising:

conveying a tool string within a wellbore that extends into a subterranean formation, wherein the tool string comprises:

a measurement tool comprising a sensor and electronic components communicatively connected with the sensor; and a perforating tool located downhole from the measurement tool;

while conveying the tool string within the wellbore, transmitting from a first component of surface equipment to the tool string electrical power having a first polarity to electrically power the electronic components while preventing passage of the electrical power having the first polarity to the perforating tool; and while transmitting from a second component of the surface equipment to the tool string electrical power having a second polarity to electrically power the perforating tool:

detonating the perforating tool to perforate the subterranean formation;

supplying the electrical power having the first polarity to the electronic components to electrically power the electronic components and the sensor; and operating the sensor to generate information indicative of detonation of the perforating tool.

23. The method of claim 22 further comprising, while transmitting from the second component of the surface equipment to the tool string electrical power having the second polarity to electrically power the perforating tool, operating the electronic components to record the information indicative of the perforating tool detonation.

24. The method of claim 22 wherein the measurement tool further comprises an electrical storage device, and wherein the electrical power having the first polarity to electrically power the electronic components and the sensor is supplied from the electrical storage device.

25. The method of claim 22 wherein supplying the electrical power having the first polarity to electrically power the electronic components and the sensor comprises reversing polarity of the electrical power having the second polarity to the electrical power having the first polarity to electrically power the electronic components and the sensor.

* * * * *